US005239738A

United States Patent [19]

Lisec

[11] Patent Number: 5,239,738

[45] Date of Patent: Aug. 31, 1993

[54] PROCESS FOR INSERTING PLATE-SHAPED STRUCTURAL COMPONENTS IN FRAMES

[76] Inventor: Peter Lisec, Bahnhofstrasse 34, A-3363 Amstetten-Hausemening, Austria

[21] Appl. No.: 769,528

[22] Filed: Oct. 2, 1991

[30] Foreign Application Priority Data

Oct. 2, 1990 [AT] Austria ..... 1986/90

[51] Int. Cl.[5] ..... B23P 11/02

[52] U.S. Cl. ..... 29/451; 29/462; 29/DIG. 44

[58] Field of Search ..... 29/448, 462, 450, 451, 29/DIG. 44

[56] References Cited

U.S. PATENT DOCUMENTS 2,683,925 7/1954 Russell et al. .
3,694,894 10/1972 Jellack et al. ..... 29/DIG. 44 X
4,118,266 10/1978 Kerr et al. ..... 29/462 X

FOREIGN PATENT DOCUMENTS 2017443 4/1970 Fed. Rep. of Germany ..... 29/462
2335688 8/1974 Fed. Rep. of Germany .
2648295 4/1978 Fed. Rep. of Germany .
8900041.2 6/1989 Fed. Rep. of Germany .
2036842 7/1980 United Kingdom .

*Primary Examiner*—Timothy V. Eley
*Attorney, Agent, or Firm*—Young & Thompson

[57] ABSTRACT

Glass plates (1) are inserted in frames (2) wherein the glass plate (1) is held between seals (3 and 4), one seal (3) of which is attached to the frame (2) and the other seal (4) of which is attached to a strip (6) lockable onto the frame (2). The glass plate (1), with compression of the seal (3) inserted in the frame (2), is displaced in the frame (2) transversely to its surface by a pressure difference between one side and the other side of the glass plate (1). Once the glass plate (1) is thus displaced with respect to the frame (2), the strips (6) carrying the seal (4) are inserted in the frame (2). An apparatus for performing this process includes a support for the frame (2) which is a flat element (10) wherein at least one opening (11) is provided for placement under a vacuum.

2 Claims, 1 Drawing Sheet

Fig. 1
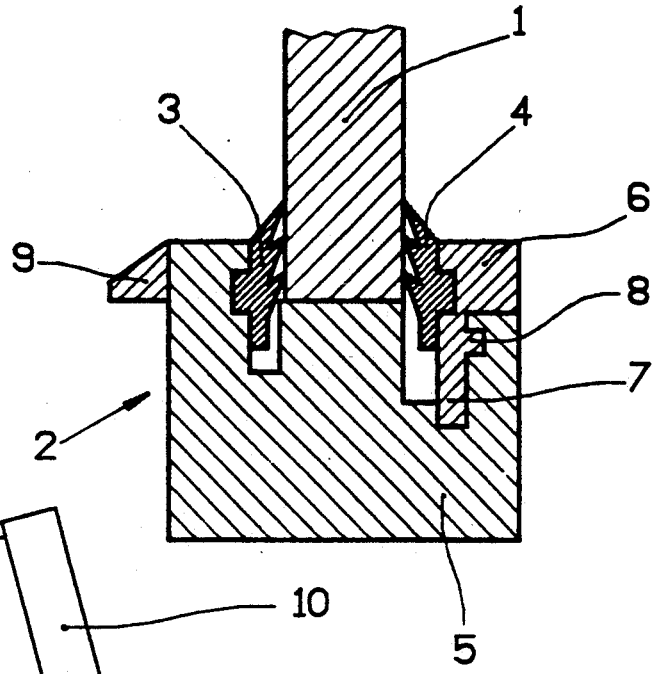
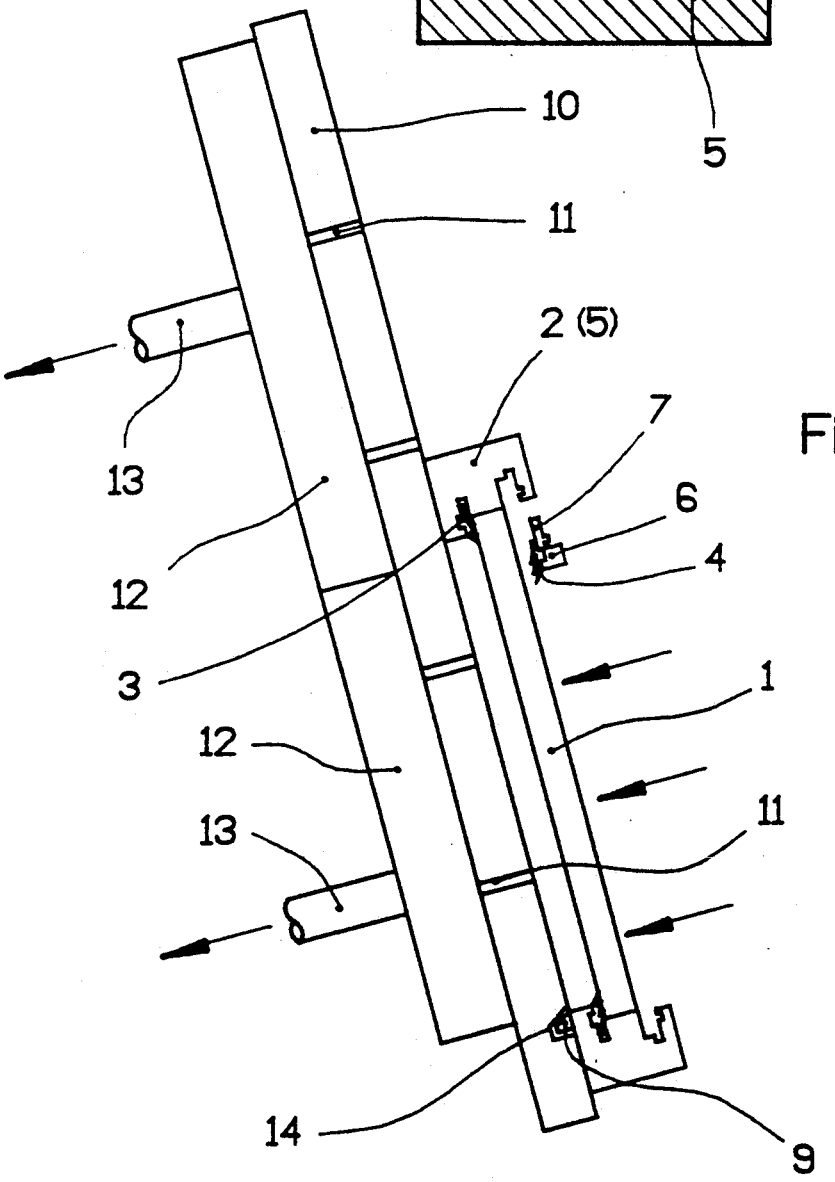
Fig. 2

PROCESS FOR INSERTING PLATE-SHAPED STRUCTURAL COMPONENTS IN FRAMES

BACKGROUND OF THE INVENTION

1. Field of the Invention

The invention relates to a process for inserting plate-shaped structural components, especially glass plates, in frames wherein the structural component is arranged between elastic seals located on both sides of the structural component and is thereby held in the frame, and wherein the seal on one side is attached to the frame and the seal on the other side is attached to strips lockable to the frame. 2. Description of the Related Art The insertion of plate-shaped structural parts, such as glass plates, insulating glass panes, and the like, in bipartite frames is performed in such a way that the plate-shaped structural part is displaced in the frame with compression of one of the seals, so that the strip with the second seal can be locked together with the frame. This displacement of the plate-shaped structural part in the frame takes place manually wherein the strip is then pounded in or pressed in with a tool in order to lock the strip to the frame.

It has also been suggested to displace the plate-shaped structural component with respect to the frame by suction cups wherein the suction cups engage the structural component from the side where the glass plate or like structural component is also contacted by the sealing strips connected to the frame.

However, due to the use of suction cups for displacing the structural part, the plate-shaped structural part is deformed so that breakage frequently occurs, especially during the insertion of glass plates, or the insertion of strips is made difficult in the sections where the structural part has not been adequately displaced.

German Patent No. 2,335,688 discloses a device for glazing window frames, door frames, or the like, with a glass rabbet. In this arrangement, a sealing profile of an elastic, water-impermeable material, vulcanizable or curable by heating, is introduced into the glass rabbet, and a glazing element is placed on the sealing profile. The window frame, door frame, or the like is then placed with its side facing away from the glass rabbet against a planar contact surface, and then the glazing element is placed on the sealing profile. Thereupon, a vacuum is produced in the space between the glazing element, the sealing profile, the door frame, window frame, or the like, and the contact surface; this vacuum is eliminated again after the vulcanization and/or curing of the sealing profile. In this conventional apparatus, a planar contact surface for the window frame, door frame, or the like is provided, equipped with a gastight, elastic cover layer. Furthermore, an exhaust opening connected with an evacuating device is provided which is arranged in the contact surface. Nothing can be derived from German Patent No. 2,335,688 regarding the way in which the glass holding strip with a sealing profile is mounted on the side in opposition to the sealing profile of a vulcanizable material. Also, German Patent No. 2,335,688 contains no indication that the glass holding strip is to be attached to the frame while the space between the glazing element and the contact surface is exposed to a vacuum.

SUMMARY OF THE INVENTION

The invention is based on the object of indicating a process of the type discussed above, facilitating the insertion of plate-shaped structural components, especially the connection of the strips, carrying the gaskets, with the frame.

The procedure according to this invention is such that the structural component is displaced in the frame transversely to the surface of this component with deformation, especially compression, of the seal inserted in the frame by a pressure difference between one side and the other side of the structural component, especially the glass plate; with the structural component displaced in this way with respect to the frame, the strips carrying the other seal are inserted in the frame; and thereupon the pressure difference is again eliminated.

It has been found surprisingly that even a relatively minor pressure difference (a few millibars) is enough for displacing the plate-shaped structural component (glass plate) uniformly toward the seal already joined to the frame, wherein this seal is compressed so that there is adequate space on the opposite side for inserting the strip with the other seal.

The procedure in the process of this invention is preferably to produce the pressure difference by the application of a vacuum over the entire surface of the structural part.

In order to perform the process of this invention, an apparatus is sufficient which is of a comparatively simple structure. In a preferred embodiment, this apparatus with a support for the frame is characterized in that the support is a flat element wherein at least one opening is provided which can be exposed to a vacuum.

When operating with the apparatus of this invention, it is sufficient to lay the frame against the flat element constituting the support, to place at least one opening in the flat element under a vacuum whereupon the plate-shaped structural component is displaced in the frame as described above and the strip with the other seal can be inserted in the frame without any problems. In this connection, it is advantageous as well, especially if the structural part is a glass plate, that the structural part is shifted in the zone of its entire periphery so that the strips with the other gasket can be inserted all around in one working step.

In order to be able to build up the vacuum quickly, an embodiment of the apparatus of this invention is advantageous wherein the provision is made that several outlet openings exposable to a vacuum are arranged in the flat element.

The provision can be made, for being able to use the apparatus of this invention for differently sized frames, that the openings exposable to a vacuum can be connected in groups to one or several vacuum sources. In this embodiment, vacuum is applied only to the opening or, respectively, the openings which are located in the region of the inner space of the frame. In this way, energy for the production of a vacuum can be saved and the required vacuum is yet quickly obtained. In this embodiment, the further provision can be made that the openings, combined into individual groups, can be connected and, respectively, disconnected to and from the vacuum source by the opening and closing of valves.

In case several openings are provided in the flat element, then it is recommended to design the apparatus so that at least one chamber is arranged on the rear side of the flat element, a conduit leading from this chamber to the vacuum source.

In order to ensure the required sealing action between the frame and the flat element, the apparatus according to this invention can be distinguished by the feature that the flat element is an essentially planar plate exhibiting a preferably elastically deformable surface.

In case the frames in which the plate-shaped structural parts, such as glass plates or insulating glass panes, are to be inserted are window casements or doors carrying along one frame leg a rain-barrier strip (weather strip), then an embodiment of the apparatus of this invention is advantageous wherein the provision is made that the flat element exhibits at least one groove or a like depression for the accommodation of rain-barrier strips provided at the frame.

BRIEF DESCRIPTION OF THE DRAWINGS

Additional details and features of the invention can be seen from the following description of embodiments, reference being had to the appended drawing wherein:

FIG. 1 is a sectional view of an embodiment for a frame having an inserted glass plate, and FIG. 2 shows schematically and in a lateral view an apparatus for performing the process according to this invention.

DETAILED DESCRIPTION OF THE PREFERRED EMBODIMENTS

A glass plate 1 is held in a frame 2 between seals 3 and 4. In this arrangement, one seal 3—in case of windows the seal on the outside—is inserted in section 5 of the frame 2 which also carries a weather strip 9. The other seal 4 is inserted in a strip 6 engaging with an extension 7 into a groove in the section 5 of the frame 2 and being fixedly mounted to this section 5 by the engagement of a longitudinally extending rib 8 into a further groove of the section 5 of frame 2. The frame 2 and its sections 5 and strips 6 can consist of wood, metal or synthetic resin wherein also combinations of these materials are possible. As known per se, the frame section 5 can be made up, for example, of several (hollow) profile strips joined with one another by way of heat-insulating connecting pieces. Attention is once again invited to the fact that the frame construction shown in FIG. 1 is merely one example for frames. The only important point resides in that the glass plate 1 is held between the gaskets or seals 3 and 4 and the frame consists of at least two sections 5 and strips 6 each of which carries one of the gaskets or seals 3 and 4, respectively.

It can be seen that the glass plate 1 must be displaced, in order to be able to insert the strip 6 with the seal 4, in a direction toward the seal 3—i.e. toward the left as seen in FIG. 1—with deformation of this seal 3. The apparatus illustrated in FIG. 2 serves this purpose. This apparatus comprises a flat element 10 wherein several bores 11 are provided in the illustrated embodiment. In the embodiment shown in FIG. 2, two chambers 12 are located on the rear side of the flat element 10; these chambers 12 are in communication with a vacuum source (not shown) by way of conduits 13. By exposing the chamber 12 to a vacuum, the bores 11 in the flat element 10 are likewise under vacuum.

In order to firmly seat the glass plate 1 in the frame 2, the section 5 of the frame 2 is placed, with the weather strip 9 leading, onto the flat element 10, and a vacuum is generated in the lower chamber 12 by activating the vacuum generator (pump, blower). Since the frame section 5 covers only bores 11 emanating from the lower chamber 12, the upper chamber 12 is not placed under a vacuum. This selective suction can be accomplished by closing a shutoff member (not shown) provided in the conduit 13 leading to the upper chamber 12.

In this way, a pressure difference is produced between the side facing away from the flat element 10 and the side of the glass plate 1 facing this element 10, this pressure difference moving the glass plate 1 in the frame section 5 transversely to its flat extension toward the flat element 10 (i.e. toward the left in FIG. 2), with the seal 3 being compressed, so that there is sufficient space in the frame section 5 on the side facing away from the flat element 10 for an insertion of the strips 6 with the seal 4 in the frame section 5 without any problems.

Once the strips 6 with the seals or gaskets 4 have been inserted all around in the frame section 5, the vacuum in the lower chamber 12 is eliminated, and the frame 2, with the glass plate 1 now having been inserted and fixedly mounted, held between the seals 3 and 4, is removed from the flat element 10.

FIG. 2 shows additionally that a groove 14 is provided in the flat element 10, for example, in the zone of its lower rim; the weather strip 9 engages into this groove 14 so that the frame 2 can contact the flat element 10 in a planar fashion.

The front side of the flat element 10 is advantageously designed to be elastically resilient so that a satisfactory sealing effect is attained for the section 5 with respect to the flat element 10.

It can be seen that, with the operating technique according to this invention and with the use of the apparatus of this invention, pressure acts uniformly on the plate-shaped structural component (in the illustrated embodiment a glass plate 1), over the entire surface of the component, so that the latter is exposed to a uniform load, without any stress peaks, also in its marginal zone where it rests on the seal 3 in the section 5; consequently, as if one were to operate with suction cups, a uniform displacement of the plate-shaped structural component 1 in the section 5 is attained, and the insertion of the strips 6 with the gaskets or seals 4 is simplified.

What is claimed is:

1. In a process for inserting a plate-shaped structural component having opposite sides into a frame wherein the structural component is arranged between two elastic seals located on the opposite sides of the structural component and is thereby held in the frame, and wherein one of the elastic seals located on one of the opposite sides is attached to the frame and the other one of the elastic seals located on the other one of the opposite sides is attached to strips lockable to the frame; the improvement comprising the steps of:

displacing the structural component in the frame transversely to one surface of this structural component with deformation of the one elastic seal inserted in the frame by generating a pressure difference between the one of the opposite sides and the other one of the opposite sides of the structural component;

inserting in the frame the strips carrying the other one of the elastic seals with the structural component displaced in this way with respect to the frame; and thereafter relieving the pressure difference so that the structural component is retained securely in the frame.

2. Process according to claim 1, wherein the pressure difference is generated by a vacuum applied to the one of the opposite sides of the structural component.

* * * * *